US005096117A

United States Patent [19]

Owen

[11] Patent Number: 5,096,117

[45] Date of Patent: Mar. 17, 1992

[54] RAILROAD GRADE CROSSINGS

[75] Inventor: S. Hudson Owen, Marshfield, Wis.

[73] Assignee: Kerr-McGee Chemical Corporation, Oklahoma City, Okla.

[21] Appl. No.: 706,465

[22] Filed: May 28, 1991

[51] Int. Cl.[5] ..... E01B 21/04

[52] U.S. Cl. ..... 238/8; 238/6; 404/40

[58] Field of Search ..... 238/1-9, 238/12, 24, 25, 27, 47, 109, 118; 404/40, 43, 46; 24/363, 364, 359

[56] References Cited

U.S. PATENT DOCUMENTS

| | | | |
|---|---|---|---|
| 1,191,561 | 7/1916 | Burns . | |
| 1,237,542 | 8/1917 | Morgal | 404/40 |
| 1,658,444 | 2/1928 | King | 238/8 |
| 1,812,707 | 6/1931 | Nagel . | |
| 2,256,025 | 9/1941 | Hoak | 238/8 |
| 2,377,211 | 5/1945 | Cocken | 404/40 |
| 2,496,739 | 2/1950 | Montgomery | 238/8 |
| 2,584,388 | 2/1952 | Husband | 238/6 |
| 3,612,394 | 10/1971 | Gagnon . | |
| 4,176,789 | 12/1979 | Rich | 238/8 |
| 4,732,320 | 3/1988 | Owen | 238/8 |
| 4,880,158 | 11/1989 | Cook | 238/8 |
| 4,892,249 | 1/1990 | Owen . | |
| 4,899,932 | 2/1990 | Beachy et al. . | |
| 4,919,330 | 4/1990 | WInger . | |

OTHER PUBLICATIONS

"Quick Release Farm Crossing" Crossties, Jun. 1989, 5 page article.

"New E-Z Panel Grade Crossing", Aug. 1989, 1 page article.

*Primary Examiner*—Frank E. Werner
*Assistant Examiner*—Brian K. Dinicola
*Attorney, Agent, or Firm*—Herbert M. Hanegan

[57] ABSTRACT

A plurality of timbers connected to ties at a railroad grade crossing. Hooks are connected to some of the ties. When the timbers are disposed on the ties, the hooks are inserted into the timbers. Pins are disposed through the ties and through portions of the hooks for connecting the timbers to some of the ties. The timbers are connected in groups of two or three timbers to form field deck panels and gauge deck panels.

21 Claims, 4 Drawing Sheets

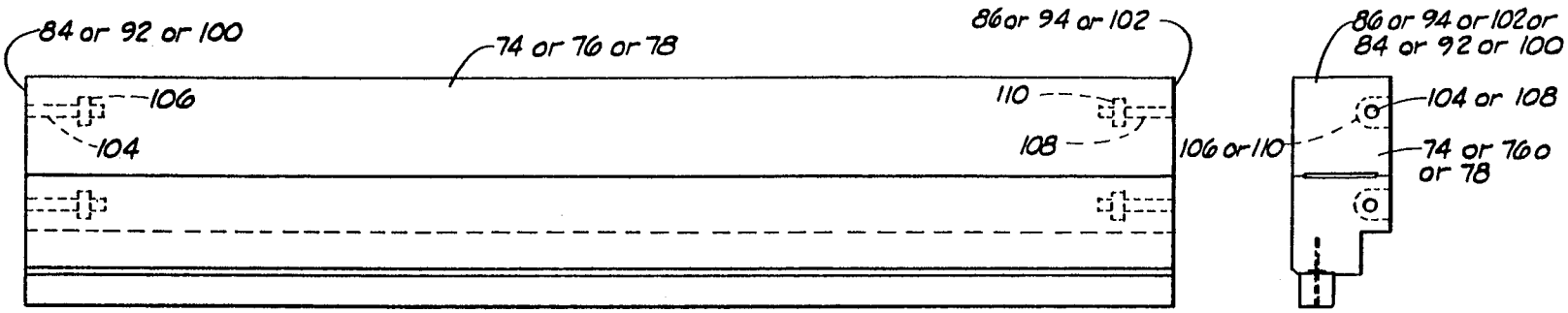
FIG. 5
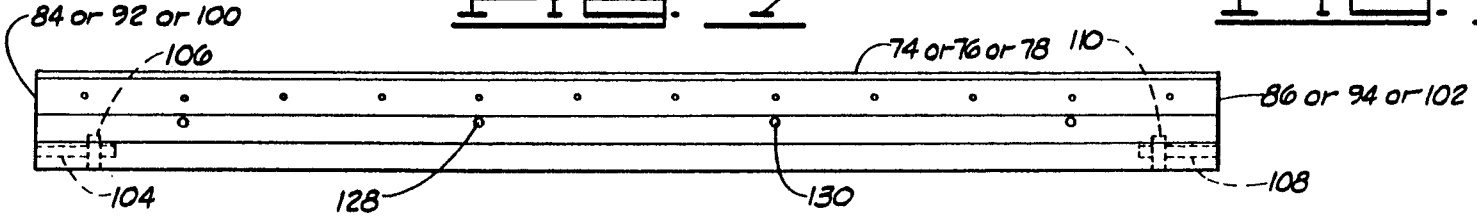
FIG. 7
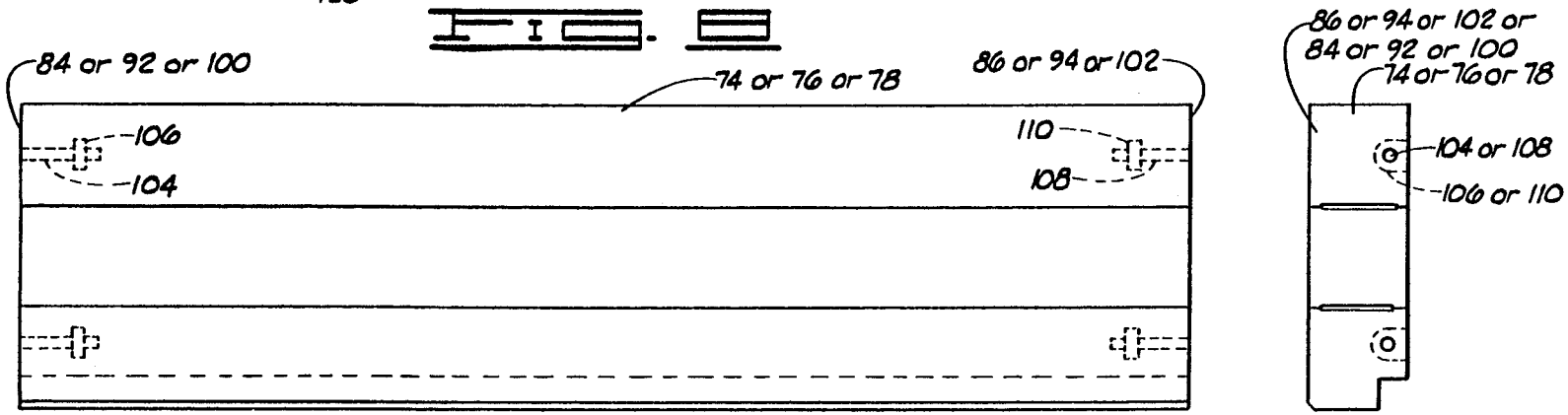
FIG. 8
FIG. 10
FIG. 12

RAILROAD GRADE CROSSINGS

FIELD OF THE INVENTION

The present invention generally relates to timbers supported on ties at a railroad grade crossing wherein the timbers are connected to some of the ties by way of hooks and pins.

BRIEF DESCRIPTION OF THE DRAWINGS

FIG. 7 is a top elevational view of a typical pair of field deck timbers constructed in accordance with the present invention.

FIG. 8 is a side elevational view of the field deck panel of FIG. 7.

FIG. 9 is an end elevational view of the field deck panel of FIGS. 7 and 8.

FIG. 10 is a top plan view of a typical gauge deck timbers constructed in accordance with the present invention.

DESCRIPTION OF THE PREFERRED EMBODIMENTS

Figures 1, 2, 3:
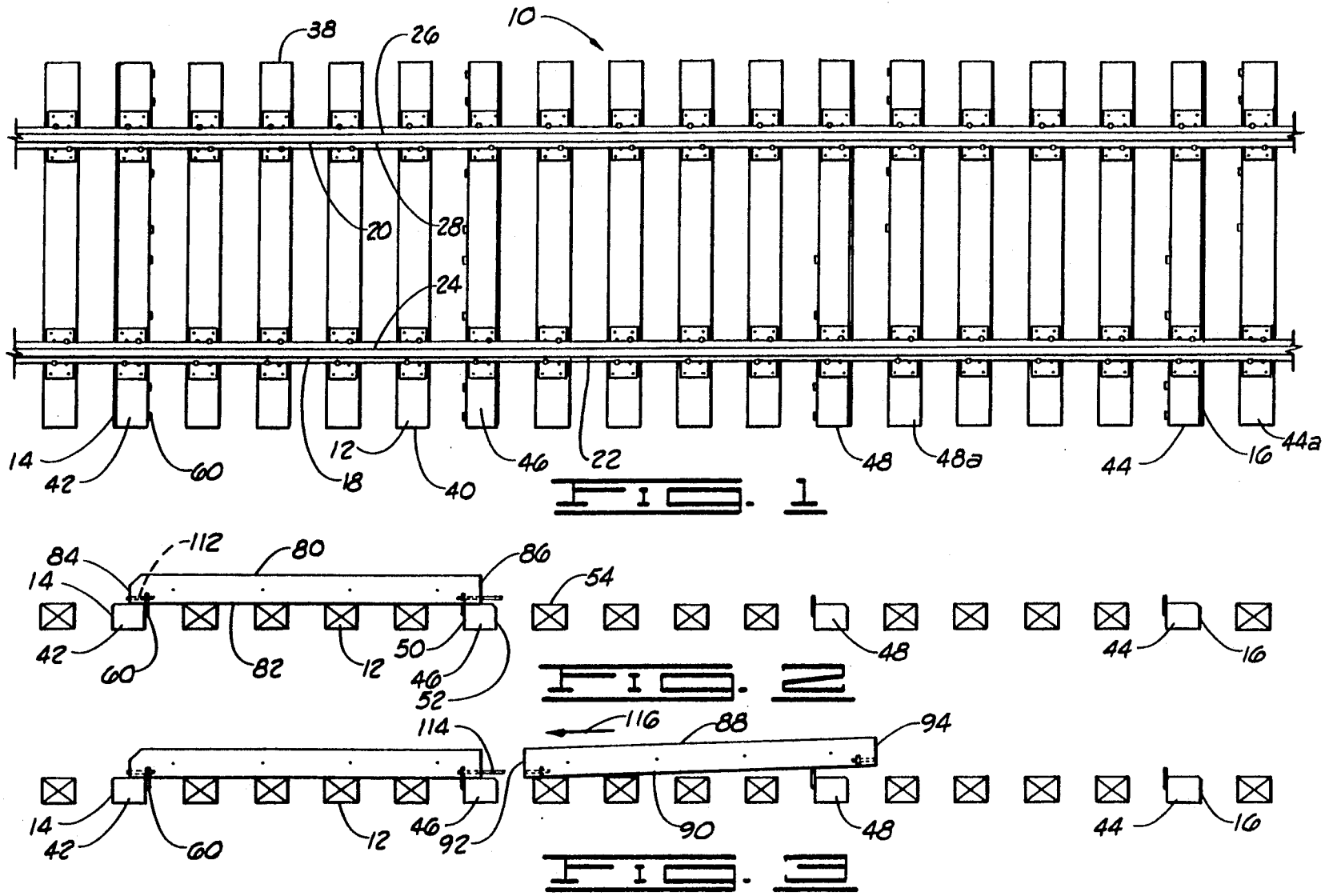
FIG. 1 is a top plan view of a railroad grade crossing without the timbers of the present invention installed thereon.
FIG. 2 is a schematic, partial sectional view of the railroad grade crossing of FIG. 1 showing the installation of a first end timber.
FIG. 3 is a view similar to FIG. 2, but showing the start of the installation of an intermediate timber.

Shown in FIG. 1 is a typical railroad grade crossing designated by the general reference numeral 10 without the timbers of the present invention installed thereon. The railroad grade crossing 10 comprises a plurality of ties 12 (only one tie 12 being designated with a reference numeral in the drawings) extending from a first end 14 to a second end 16 of the railroad grade crossing 10. The ties 12 are supported on ballast (not shown).

A pair of spaced apart rails 18 and 20 are secured to the ties 12. The rails 18 and 20 extend through the railroad grade crossing 10 with each of the rails 18 and 20 extending beyond the first and the second ends 14 and 16. The rail 18 includes a field side 22 and a gauge side 24, as shown in FIG. 1. The rail 20 includes a field side 26 and a gauge side 28. The gauge sides 24 and 28 of the respective rails 18 and 20 face each other and are spaced a distance apart.

Each of the ties 12 has opposite ends 38 and 40 (only one of the ends 38 and only one of the ends 40 being designated with a specific reference numeral in FIG. 1). Each of the ties 12 extends between the rails 18 and 20 and each of the ties 12 extends a distance beyond the respective field sides 22 and 26 of the rails 18 and 20. The rails 18 and 20 are supported on and connected to the upper surfaces of the ties 12.

Railroad grade crossings constructed in the manner just described with respect to the railroad grade crossing 10 are well known in the art and a detailed description of such railroad grade crossings is not required herein.

Figures 11, 12, 13, 14, 15, 16, 17, 18:
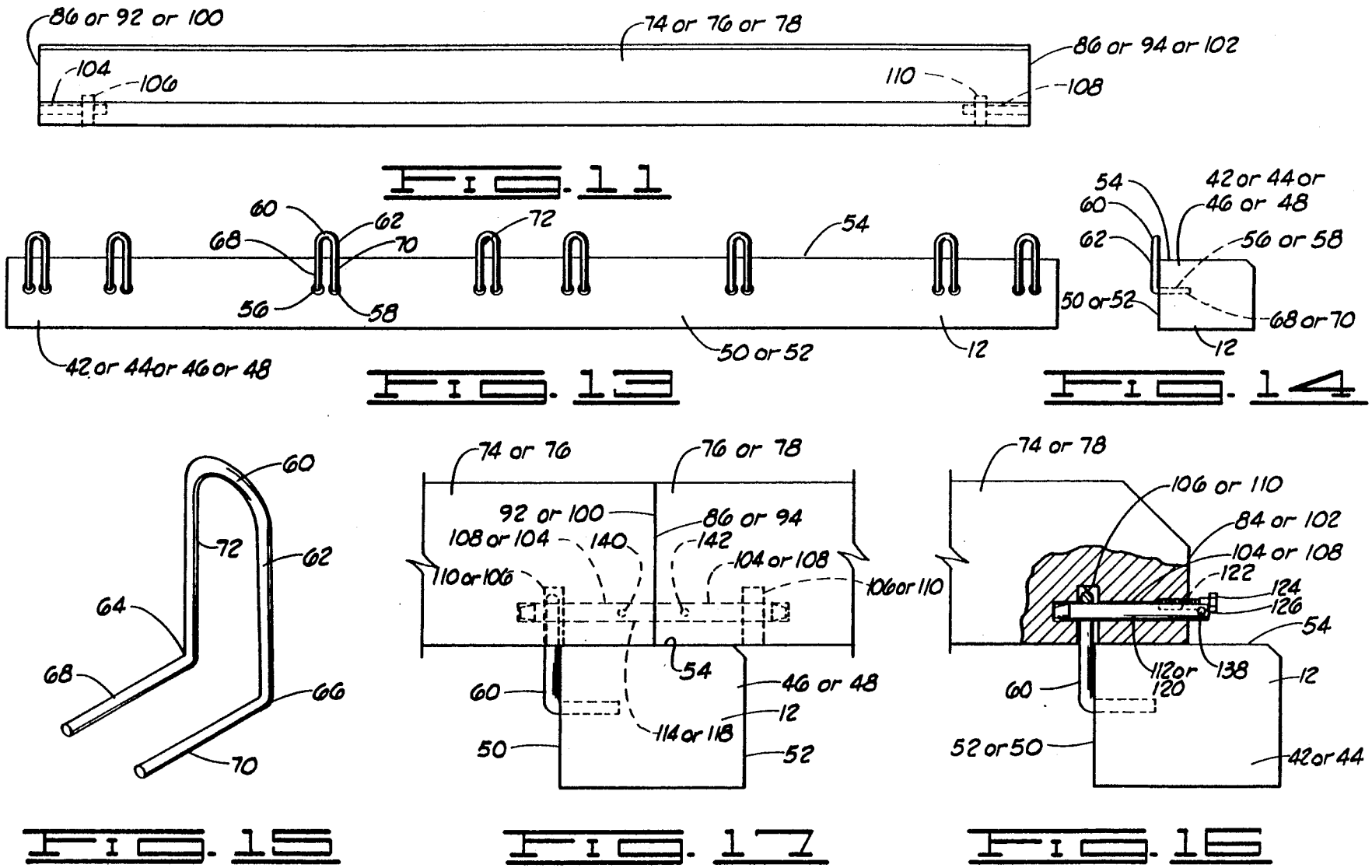
FIG. 11 is a side elevational view of the gauge deck panel of FIG. 10.
FIG. 12 is an end elevational view of the gauge deck panel of FIGS. 10 and 11.
FIG. 13 is a side elevational view of a typical end tie or intermediate tie showing the hooks of the present invention installed thereon.
FIG. 14 is an end elevational view of the tie of FIG. 13.
FIG. 15 is a perspective view of a typical hook constructed in accordance With the present invention.
FIG. 16 is an end elevational, partial sectional view of a typical tie showing the connection of a typical timber to such tie.
FIG. 17 is a side elevational view showing the connection of a typical end timber to a typical intermediate timber.

In the present invention, as shown in FIGS. 15, some of the ties 12 are modified to form a first end tie 42 disposed generally at or near the first end 14 of the railroad grade crossing 10, a second end tie 44 disposed generally at or near the second end 16 of the railroad grade crossing 10, a first intermediate tie 46 disposed generally between the first and the second end ties 42 and 44 and a second intermediate tie 48 disposed generally between the first and the second end ties 42 and 44 and spaced a distance from the first intermediate tie 46.

Each of the ties 12, including the ties 42, 44, 46 and 48, have a forward side 50, a rearward side 52 and an upper surface 54 (the forward side 50, the rearward side 52 and the upper surface 54 of only one of the ties 12 being designated by specific reference numerals in FIG. 2).

A typical first end tie 42 or second end tie 44 or first intermediate tie 46 or second intermediate tie 48 is shown in FIGS. 13 and 14. The side of the tie 42 or 44 or 46 or 48 shown in FIG. 13 is either the forward side 50 or the rearward side 52 depending upon the particular tie. With respect to the first end tie 42 the side shown in FIG. 13 is the rearward side 52. With respect to the second end tie 44 or the intermediate ties 46 or 48, the side shown in FIG. 13 is the forward side 50.

As shown in FIGS. 13 and 14, a plurality of pairs of hook post openings 56 and 58 (only one pair of hook post openings 56 and 58 is designated with reference numerals in FIGS. 13 and 14) are formed in the forward or rearward side 50 or 52 of the each tie 42, 44, 46 and 48. Each of the hook post openings 56 and 58 extends a distance through the tie 42, 44, 46 or 48.

A plurality of hooks 60 (only one of the hooks 60 is designated with a reference numeral in FIG. 13 and 14) are connected to the forward side 50 or the rearward side 52 of the respective ties 42 or 44 or 46 or 48. Only one of the hooks 60 is designated with specific reference numerals in each of the FIGS. 1–6.

As shown in FIGS. 13 and 14 and 15, each hook comprises a U-shaped member 62 having opposite ends 64 and 66 (FIG. 15). Each hook 60 also includes a pair of posts 68 and 70 (FIGS. 14 and 15). Each posts 68 and 70 has opposite ends. One end of the post 68 is connected to the end 64 of the U-shaped member 62 and one end of the post 70 is connected to the end 66 of the U-shape member 62. Each of the posts 68 and 70 extends about perpendicularly from the U-shape member 62.

The hook post openings 56 and 58 each have a diameter slightly smaller than the diameter of the posts 68 and 70.

A plurality of hooks 60 are connected to the forward side 50 of each of the ties 44, 46 or 48. A plurality of hooks 60 are connected to the rearward side 62 of the first end tie 42. More particularly, each hook 60 is connected to the tie 42, 44, 46 or 48 via one of the pairs of hook post openings 56 and 58. The posts 68 is forced fitted into the hook post opening 58 and the post 68 is forced fitted into the hook post opening 56 to secure each of the hooks 60 to the tie 42, 44, 46 or 48.

In the assembled position, a portion of the U-shape member 62 extends a distance upwardly from the upper surface 54 of the tie 42, 44, 46 or 48. A portion of the U-shape member 62 forms a hook opening 72 (FIG. 15 and shown in FIG. 13 with respect to one of the hooks 60). A portion of the hook opening 62 extends above the upper surface 54 of the tie 42 or 44 or 46 or 48. The hooks 60 are spaced along the tie 42 or 46 or 48 in a specific manner to be made more apparent below.

As shown in FIGS. 1–6, the hooks 60 more particularly are connected to the rearward side 52 of the first end tie 42. The hooks 60 more particularly are connected to the forward side 50 of the intermediate ties 46 and 48 and the second end tie 44.

Figure 6:
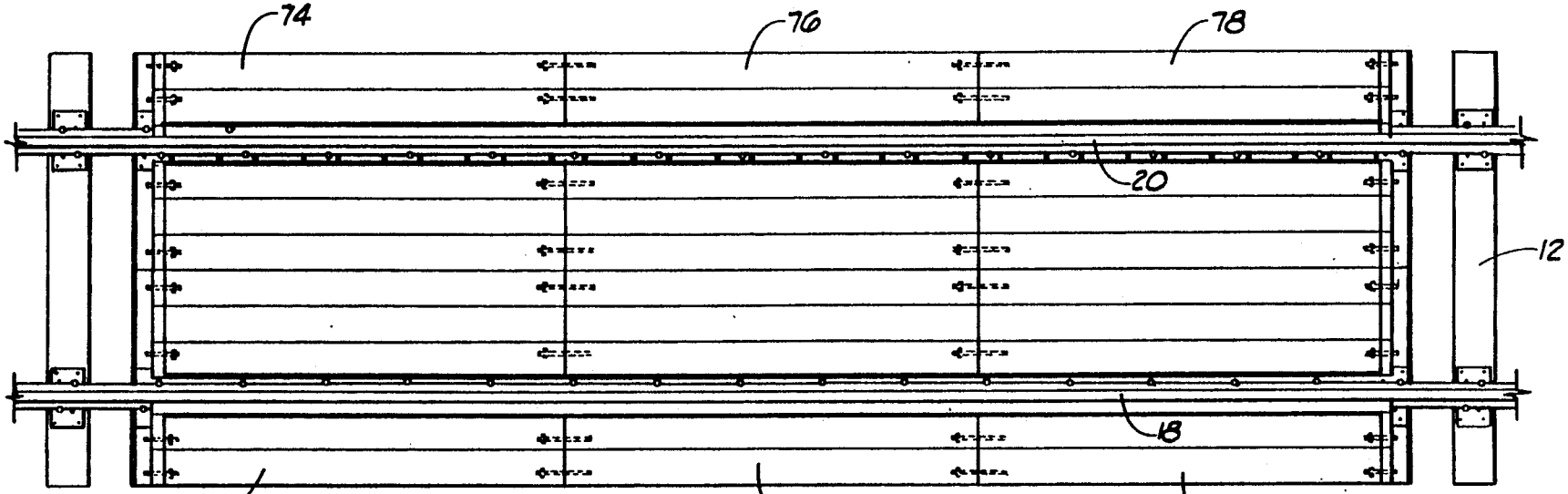
FIG. 6 is a top plan view, similar to FIG. 1, but showing the timbers of the present invention installed at the railroad grade crossing.

The railroad grade crossing 10 comprises a plurality of first end timbers 74 (only two of the timbers 74 being designated with a reference numeral in FIG. 6), a plurality of intermediate timbers 76 (only two of the timbers 76 being designated with a reference numeral in FIG. 6) and a plurality of second end timbers 78 (only two of the timbers 78 being designated with a reference numeral in FIG. 6).

Figure 5:
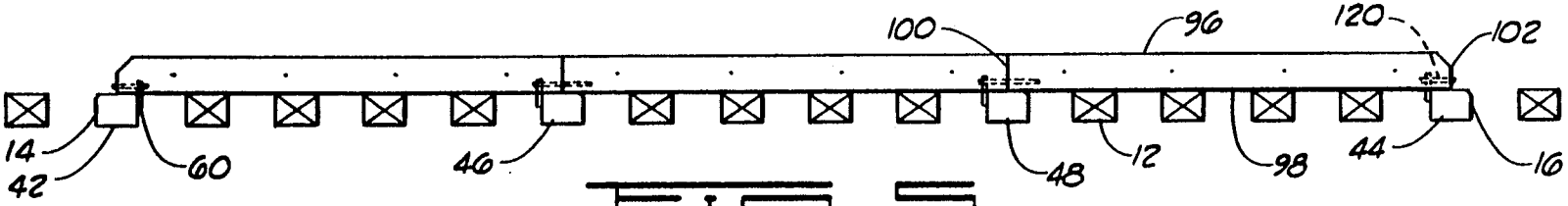
FIG. 5 is a view similar to FIG. 2, but showing the first end timber, the intermediate timber and a second end timber installed on the ties.

Each of the first end timbers 74 has an upper surface 80 (FIG. 2), a lower surface 82 (FIG. 2), a first end 84 (FIG. 2) and a second end 86 (FIG. 2). Each of the intermediate timbers 76 has an upper surface 88 (FIG. 3), a lower surface 90 (FIG. 3), a first end 92 (FIG. 3) and a second end 94 (FIG. 3). Each of the second end timbers 78 has an upper surface 96 (FIG. 5), a lower surface 98 (FIG. 5), a first end 100 and a second end 102, (FIG. 5).

A portion of a typical end timber 74 or 78 is shown in FIG. 16 connected to the end tie 42 or 44 respectively. Typical end or intermediate timbers 74 or 76 or 78 are shown in FIGS. 7, 8, 9, 10, 11 and 12 with only one of the timbers being designated with a specific reference numeral.

A pin opening 104 is formed through the first ends 84, 92 and 100 of each of the first end timbers 74, the intermediate timbers 76 and the second end timbers 88, as shown in FIGS. 7, 8, 9, 10, 11, 12, 16 and 17 with only one of the pin openings 104 being designated with a specific reference numeral in the drawings. A hook recess 106 is formed through each lower surface 82, 90 and 98 of the respective first end timber 74, the intermediate timber 76 and second end timber 78, as shown in FIGS. 7, 8, 9, 10, 11, 12, 16 and 17 with only one of the hook recess 106 being designated with a specific reference numeral in the drawings. Each pin opening 104 extends a distance through the respective timber 74, 76 or 78. Each hook recess 106 extends a distance through each respective timber 74, 76 or 78 and a portion of each hook recess 106 intersects the pin opening 104 in the respective timbers 74, 76 or 78.

A pin opening 108 is formed through the second ends 86, 94 and 102 of each of the first end timbers 74, the intermediate timbers 76 and the second end timbers 88, as shown in FIGS. 7, 8, 9, 10, 11, 12, 16 and 17 with only one of the pin openings 108 being designated with a specific reference numeral. A hook recess 110 is formed through each lower surface 86, 94 and 102 of the respective first end timber 74, intermediate timber 76 and second end timber 78, as shown in FIGS. 7, 8, 9, 10, 11, 12, 16 and 17 with only one of the hook recess 110 being designated with a specific reference numeral. Each pin opening 108 extends a distance through the respective timber 74, 76 or 78. Each hook recess 110 extends a distance through each respective timber 74, 76 or 78 and a portion of each hook recess 110 intersects the pin opening 108 in the respective timbers 74, 76 or 78.

It should be noted that the pin openings 104 and 108 and the hook recesses 106 and 110 may be formed in all of the timbers 74, 76 and 78. However, in one embodiment, some of the timbers 74, 76 and 78 do not include the pin openings 104 and 108 or the hook recesses 106 and 110 in a manner and for reasons to be made more apparent below.

The installation of the timbers 74, 76 and 78 is illustrated in FIGS. 2, 3, 4 and 5. The first end timber 74 is positioned generally above the upper surfaces 54 of some of the ties 14. In this position, the first end timber 74 is lowered to a position wherein the first end timber 74 is disposed on the upper surface 54 of some of the ties 12, as shown in FIG. 2.

One of the first end timbers 74 is disposed on the upper surface 54 of some of the ties 12 and positioned so that the first end 84 is disposed generally on the upper surface 54 of the first end tie 42. The first end timber 74 is positioned on the first end tie 42 such that one of the hooks 60 is disposed in the hook recess 106 near the first end 84 of the first end timber 74. The hook 60 extends through the hook recess 106 to a position wherein the hook opening 72 is aligned with the pin opening 104. Further, the first end timber 74 is positioned on the upper surface 54 of the first intermediate tie 46 in a position wherein one of the hooks 60 on the first intermediate tie 46 extends through the hook recess 110 formed near the second end 86 of the first end timber 74. In this position, the hook 60 extends through the hook recess 110 to a position wherein the hook opening 72 is aligned with the pin opening 108.

In this position of the first end timber 74, an end pin 112 (FIGS. 2 and 16) is driven through the pin opening 104 to a position wherein the end pin 112 extends through the hook opening 72 of the hook 60 disposed in the hook recess 106. In this position of the end pin 112, the end pin 112 cooperates with the hook 60 to prevent the first end 84 of the first end timber 74 from being moved in the upwardly direction from the upper surface 54 of the tie 42 thereby connecting the first end 84 of the first end timber 74 to the first end tie 42. The remaining first end timbers 74 are connected to the upper surface 54 of the first end tie 42 in a manner exactly like that described before.

An intermediate pin 114 (FIGS. 3 and 17) is driven through the pin opening 108 in the second end 86 of the each of the first end timbers 74 to a position wherein a portion of the intermediate pin 114 extends through the hook opening 72 of one of the hooks 60 connected to the first intermediate tie 46. In this position, the intermediate pin 114 cooperates with the hook 60 on the first intermediate tie 46 to secure the second ends 86 of the first end timbers 74 to the first intermediate tie 46.

Each intermediate pin 114 is sized such that a portion of each intermediate pin 114 extends a distance outwardly from the second end 86 of each first end timber 74 after the intermediate pins 114 have been positioned in the pin openings 108.

The second end of 86 of each of the first end timbers 80 is secured to the first intermediate tie 46 in a manner exactly like that just described above.

Figure 4:
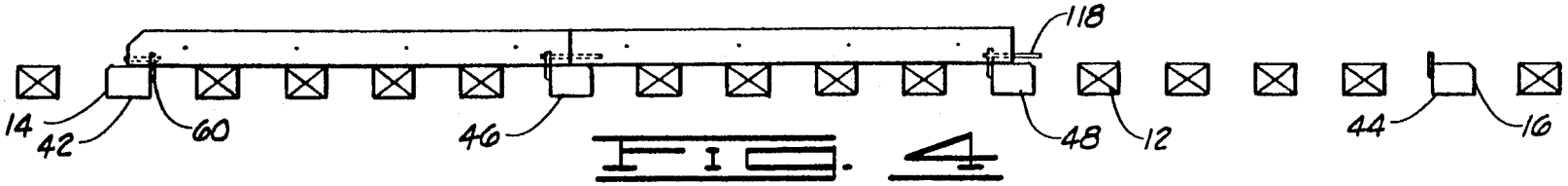
FIG. 4 is a view similar to FIG. 2 but showing the first end timber and the intermediate timber installed on the ties.

One of the intermediate timbers 76 is disposed above the upper surfaces 54 of some of the ties 12 in a position substantially as shown in FIG. 3, with the first end 82 of the intermediate timber 76 being disposed generally near the second end 86 of the first end timber 74. In this position, the intermediate timber 76 is moved in a direction 116 (FIG. 3) to a position wherein the portion of the intermediate pin 114 extending beyond the second end 86 of the first end timber 84 is disposed through the pin opening 104 in the first end 92 of the intermediate timber 76. As the intermediate timber 76 is moved in the direction 116 to position the intermediate pin 114 in the pin opening 104, the intermediate timber 76 also is moved to a position wherein the hook 60 on the second intermediate tie 48 is disposed in the hook recess 108 formed in the intermediate timber 76 near the second end 94 of the intermediate timber 76 to a position substantially as shown in FIG. 4.

In this position, a second intermediate pin 118 (FIGS. 4 and 17) is driven through the pin opening 108 in the second end 94 of the intermediate timber 76 to a position wherein a portion of the second intermediate pin 118 extends through the hook opening 72 of the hook 60 disposed in the hook recess 110 near the second end 94 of the intermediate timber 76. The second intermediate pin 118 is constructed exactly like the first intermediate pin 114. When the second intermediate pin 118 is driven in the pin opening 108, a portion of the second intermediate pin 118 extends a distance beyond the second end 94 of the intermediate timber 76. The second intermediate pin 118 disposed through the hook opening 72 cooperates with the hook 60 to connect the second end 94 of the intermediate timber 76 to the upper surface of the second intermediate tie 48 for substantially preventing movement of the second end 94 of the intermediate timber 76 in an upwardly direction away from the upper surface 54 of the intermediate tie 48.

The remaining intermediate timbers 76 are installed on the first intermediate tie 46 and the second intermediate tie 48 in a manner exactly like that described before.

After the intermediate timbers 76 have been installed, one of the second end timbers 78 is positioned generally above the upper surfaces 54 of some of the ties 12 and lowered and moved to a position wherein a portion of the second intermediate pin 118 is disposed through the pin opening 104 in the first end 100 of the second end timber 78, as shown in FIG. 5. The second intermediate pin 118 is disposed through the hook 60 disposed in the second end 94 of the intermediate timber 76 and a portion of the second intermediate pin 118 is disposed through the pin opening 104 in the first end 100 of the second end timber 78 thereby securing the first end 100 of the second end timber 78 to the second intermediate tie 48.

In this position of the second end timber 78, the second end 102 of the second end timber 78 is disposed on the upper surface 54 of the second end tie 44 and positioned so that the hook 60 on the second end tie 44 extends through the hook recess 110 near the second end 102 of the second end timber 104. In this position of the second end timber 78, a second end pin 120 (FIGS. 5 and 16) is driven through the pin opening 108 in the second end 102 of the second end timber 78 to a position wherein a portion of the second end pin 120 is disposed through the hook openings 72 of the hook 60 disposed in the hook recess 110 thereby securing the second end 102 of the second end timber 78 to the second end tie 44 for substantially preventing movement of the second end 102 of the second end timber 78 in an upwardly direction away from the upper surface 54 of the second end tie 44.

The remaining second end timbers 78 are secured to the second intermediate tie 48 and the second end tie 44 in a manner exactly like described before.

A recess 122 (FIG. 16) is formed in the end of each of the end pins 112 and 120. After the end pins 112 and 120 have been inserted through the respective pin openings 104 and 108 of the first and the second end timbers 74 and 78, a lag screw 124 (FIG. 16) is disposed in the recess 122 and screwed into the ends 84 and 102 of the first and the second end timbers 74 and 78, respectively.

The lag screws 124 each have a head 126 (FIG. 16) formed on one end thereof. When the lag screws 124 have been driven in the end timbers 74 and 78, a portion of the head 126 overlaps and engages one end of the respective end pins 112 and 120 for securing the end pins 112 and 120 in the pin openings 104 and 108 respectively for preventing inadvertent removal of the end pins 112 and 120 from the respective pin openings 104 and 108.

The hooks 60 disposed in the hook recess 106 or 110 also cooperate to position each of the timbers 74, 76, or 78 on the ties 12 for substantially preventing lateral and longitudinal movement of the ties 74, 76 or 78 in directions generally parallel end perpendicular to the ties 12.

As shown in FIG. 6, some of the first end timbers 74, intermediate timber 76 and second end timber 78 are disposed on the field sides 22 and 26 of the respective rails 18 and 20. These timbers form what maybe referred to as field deck timbers. In one preferred form, the field deck timbers are constructed in a manner like that shown in FIGS. 7, 8 and 9.

The field deck timbers comprise two timbers disposed in a side-by-side relationship with a plurality of openings 128 (FIG. 8) extending through each of the timbers. A plurality of pins 130 (FIG. 8) are disposed through the openings 128 for securing the two timbers or pairs of timbers together as an assembled unit with each pin 130 being disposed through one of the openings 128 in each of the panels. The field deck timbers are installed on the ties 42, 44, 46 and 48 in a manner exactly like that described before in connection with FIGS. 2–5, except the panels are installed as units as opposed to one timber at a time.

As shown in FIG. 6, some the timbers 74, 76 and 78 are disposed on the gauge sides 24 and 28 of the respective rails 18 and 20. These timbers disposed on the gauge sides 24 and 28 of the respective rails 18 and 20 sometimes are referred to herein as gauge deck panels.

One preferred embodiment of the gauge deck panels is shown in FIGS. 10, 11 and 12. The gauge deck timbers are constructed in groups of three timbers per group with each of the timbers in the group having openings (not shown) extending therethrough and pins (not shown) disposed through the openings to secure the timbers in a side-by-side connected relationship in a manner like that described before with respect to the pairs of timbers in the field deck panels shown in FIGS.

7, 8 and 9. The groups of three timbers comprising a gauge deck panel are installed on the end ties 42 and 44 and the intermediate ties 46 and 48 in a manner exactly like that described before in connection with FIGS. 2-5.

It should be noted that, when the gauge deck panels are grouped with three timbers being in each group, it is not necessary that the middle timber include the pin openings and hook recesses in either end of such middle timber, as indicated in FIGS. 6 and 10.

After the timbers 74, 76 and 78 have been installed in the railroad grade crossing 10, it is recommended that a tag be secured on the last timber installed stating in essence "Maintained Thru Grade Crossing Remove Timbers Starting At This End". To remove the timbers during the maintenance of the railroad grade crossing 10, one starts with the last timber installed. The operator first would remove the lag screw 124 if present. After the lag screw 124 have been removed, the operator would pull the second end pins 120 to remove the second end pins 120 from the pin openings 108 in the second ends 102 of the respective timbers 78 thereby disconnecting the second ends 102 from the second end tie 44. The operator then would raise the second ends 102 of each of the timbers 78 to remove the hooks 60 from the hook recesses 110. The operator then moves each of the timbers 78 in a direction generally away from the second ends 94 of the intermediate timbers 76 thereby removing the second intermediate pins 118 from the pin openings in the first ends 100 of the second end timbers 78 and disconnecting the first ends 100 of the second end timbers 78 from the second intermediate tie 48.

The operator then removes the second intermediate pins 118 from the second ends 94 of the intermediate timbers 76 thereby disconnecting the second intermediate pins 118 from the hooks 60 disposed in the hook recesses 110 near the second end 94 of the intermediate timbers 76 and disconnecting the second ends 94 of the intermediate timber 76 from the second intermediate tie 48.

The operator then pulls the intermediate tie 76 in a direction generally away from the second ends 86 of the first end timber 74 thereby removing the first intermediate pins 114 from the pin openings 104 and the first ends 92 of the intermediate timbers 76 and disconnecting the first ends 92 from the first intermediate tie 46.

The field deck panels and the gauge deck panels are removed in a manner exactly like that described before with respect to the removal of the timbers.

The operator then removes the first intermediate pins 114 from the first end timbers 74 thereby disconnecting the second ends 86 of the first end timbers 74 from the first intermediate tie 46.

The operator then removes the lag screws 124 in the first end 84 of the first end timber 74. The first end pins 112 the are removed from the first end 84 of the first end timbers 74 thereby disconnecting the first end 84 of the first end timbers 74 from the first end tie 42. The operator then lifts the first end timber 74 in a generally upwardly direction to disconnect the first end timber 74 from the hooks 60 in the first end tie 42 and first intermediate tie 46.

In some installations, it may be desirable to use only first end timbers 74 and second end timbers 78 with the second ends 86 of the first end timbers 74 being connected to the first end 100 of the second end timbers 78 by way of intermediate pins like the intermediate pins 114 and 118. In other applications, it may be desirable to include more than one set of intermediate timbers like the intermediate timbers 76 as opposed to the one set shown in FIG. 6. In one other embodiment, it may be desirable to use only one set of end timbers like the first end timbers 74 to cover the entire railroad grade crossing 10. In this last mentioned embodiment, the second ends 86 of the first end timbers 74 would be connected to the second end tie 44 in a manner exactly like the second ends 102 are connected to the second end tie 44 as described before.

In addition and as illustrated in the drawings, it is contemplated that the railroad grade crossing 10 is about perpendicular to the intersecting highway. In some railroad grade crossings, the railroad grade crossing is at an angle to the intersecting highway. In those applications, some of the timbers 74, 76 and 78 may be offset with respect to the remaining timbers 74, 76 and 78 to provide an angled railroad grade crossing 10. In these applications, the end ties 42, 44 and the intermediate ties 46 and 48 also are offset accordingly. As shown in FIG. 1, the hook placements on the ties **44*a* and 48*a* illustrate the stagged or offset placement. In this instance, the timbers 74, 76 and 78 are installed on the ties 12** in a manner exactly like that described before.

The end pins 112 and 120 and the intermediate ends 114 and 118 each include holes extending therethrough such as a hole 138 shown in FIG. 16 in the end pin 112 or 120 and holes 140 and 142 shown in FIG. 17 in the intermediate pin 114 and 118. The holes 138, 140 and 142 are positioned in the respective end pins 112 and 120 or intermediate pins 114 and 118 such that the holes are positioned outside the pin openings in the case of end timbers and positioned outside the pin openings after the removal of an intermediate timber with respect to the intermediate timbers. The holes 138, 140 and 142 are positioned so that an operator can insert a tool through one of the openings 138, 140 and 142 for facilitating the removal of the end pins 112 and 120 or the intermediate pins 114 and 118.

The term "timber" or "timbers" as used herein is not intended to limit the construction of such timbers to wood. Rather, the timbers may be constructed of any material suitable for railroad grade crossings.

Changes may be made in the construction and the operation of the various components, elements and assemblies described herein without departing from the spirit and scope of the invention as defined in the following claims.

What is claimed is:

1. An improved railroad grade crossing wherein a pair of spaced apart rails extend through the railroad grade crossing with each of the rails having a field side and a gauge side, an upper end and a lower end and with each of the rails being supported on a plurality of spaced apart ties with each tie having opposite ends, an upper side and a lower side, and extending between the rails with the opposite ends of each of the ties extending a distance beyond the respective field side of each rail with one of the ties being designated as a first end tie, the improvement comprising:

a first end hook connected to said first end tie;

a first end timber having a first end, a second end, an upper surface and a lower surface, a first end pin opening being formed in said first end, said first end pin opening extending a distance through the first end timber, and a first end hook recess being formed through a portion of the first end timber near the first end, said first end hook recess extending a distance through the first end timber and intersecting the first end pin opening, the first end timber being disposed on the upper surface of the first end tie and the first end hook being disposed in the first end hook recess; and a first end pin disposed in the first end pin opening, said first end pin being insertable through a portion of the first end hook disposed in the first end hook recess for connecting the first end of the first end timber to the first end tie for substantially preventing the first end of the first end timber from being moved in an upwardly direction away from the first end tie, the first end pin and the first end hook cooperating to removably connect the first end of the first end timber to the first end tie, and the first end hook disposed in the first end hook recess cooperating to position the first end timber on the first end tie and substantially prevent lateral or longitudinal movement of the first end timber in directions parallel or perpendicular to the ties.

2. The improvement of claim 1 wherein the first end tie comprises a first pair of spaced apart first hook post openings, and wherein the first end hook further comprises:

a first U-shaped member having opposite ends; and a first pair of first posts, each of said first posts having opposite ends with one end of one of the first posts being connected to one end of the first U-shape member and one end of the other first post being connected to the opposite end of the first U-shaped member, each first post being insertable through one of the first hook post openings for connecting the first end hook to the first end tie via the pair of first hook post openings.

3. The improvement of claim 2 wherein each first post extends at an angle from the first U-shaped member, and wherein a portion of the first U-shaped member forms a first hook opening and wherein a portion of the first U-shaped member extends a distance upwardly from the upper surface of the first end tie for insertion in the first end hook recess, the first end pin extending through the first end pin opening and through the first hook opening formed in the first end hook.

4. The improvement of claim 1 further comprises:

means for removably securing the first end pin in the first end pin opening for substantially preventing the inadvertent removal of the first end pin from the first end pin opening.

5. The improvement of claim 4 wherein the first end pin includes a recess extending through one end thereof and extending a distance toward the opposite end, and wherein the means for movably securing the first end pin in the first end pin opening further comprises:

first end lag screw means, the first end lag screw means having a head, the first end lag screw means being disposed in the first end of the first end timber to a position wherein a portion of the head on the first end lag screw means engages the first end pin for substantially preventing inadvertent removal of the first end pin from the first end pin opening.

6. The improvement of claim 1 wherein the first end hook recess is further defined as being formed in the lower surface of the first end timber near the first end of the first end timber, and wherein a portion of the first end hook extends a distance above the upper side of the first end tie.

7. The railroad grade crossing of claim 1 wherein the ties further include one of the ties being designated as a first intermediate tie, the improvement further comprising:

a first intermediate hook connected to the first intermediate tie; and wherein the first end timber further comprises a second end pin opening formed through the second end of the first end timber with the second end pin opening extending a distance through the first end timber, and a second end hook recess being formed through a portion of the first end timber near the second end of the first end timber with the second end hook recess extending a distance through the first end timber and intersecting the second end pin opening, the second end of the first end timber being disposed on the first intermediate tie and the first intermediate hook being disposed in the second end hook recess; and wherein the improvement further comprises:

a first intermediate pin disposed in the second end pin opening with the first intermediate pin being insertable through a portion of the first intermediate hook for connecting the second end of the first end timber to the first intermediate tie and for substantially preventing the second end of the first end timber from being moved in an upwardly direction away from the first intermediate tie, the first intermediate pin and the first intermediate hook cooperating to removably connect the second end of the first end timber to the first intermediate tie, and the first intermediate hook cooperating to position the second end of the first end timber on the first intermediate tie and substantially prevent lateral or longitudinal movement of the first end timber in directions parallel or perpendicular to the ties.

8. The improvement of claim 7 wherein the first intermediate tie comprises a pair of spaced apart first intermediate hook post openings, and wherein the first intermediate hook further comprises:

a first intermediate U-shaped member having opposite ends; and a pair of first intermediate posts, each first intermediate post having opposite ends with one end of one of the first intermediate posts being connected to one end of the first intermediate U-shaped member and one end of the other first intermediate post being connected to the opposite end of the first intermediate U-shaped member, each first intermediate post being insertable through one of the first intermediate hook post openings for connecting the first intermediate hook to the first intermediate tie via the pair of first intermediate post openings.

9. The improvement of claim 8 wherein each first intermediate post extends at an angle from the first intermediate U-shaped member and wherein a portion of the first intermediate U-shaped member forms a first intermediate hook opening and wherein a portion of the first intermediate U-shaped member extends a distance upwardly from the upper surface of the first intermediate tie for insertion in the second end hook recess, the first intermediate pin extending through the second end pin opening and through the first intermediate hook opening.

10. The improvement of claim 7 wherein the second end hook recess formed in the first end timber is defined further as being formed through the lower surface of the first end timber near the second end of the first end timber, and wherein a portion of the first intermediate hook extends a distance above the upper side of the first intermediate tie.

11. The improvement of claim 7 wherein a portion of the first intermediate pin extends a distance beyond the second end of the first end timber, and wherein the improvement further comprises:

an intermediate timber having a first end, a second end, an upper surface and a lower surface, a first intermediate pin opening being formed in the first end of the intermediate timber and the first intermediate pin opening extending a distance through the intermediate timber, the first end of the intermediate timber being disposed generally adjacent the second end of the first end timber with a portion of the first intermediate pin extending from the second end of the first end timber and extending through the first intermediate pin opening for connecting the intermediate timber to the first end timber and for connecting the first end of the intermediate timber to the first intermediate tie.

12. The improvement of claim 11 wherein one of the ties further is designated as a second intermediate tie and wherein the second end of the intermediate timber is disposed on the second intermediate tie, and wherein a second intermediate pin opening is formed through the second end of the intermediate timber with the second intermediate pin opening extending a distance therethrough, and a intermediate hook recess is formed through a portion of the intermediate timber near the second end of the intermediate timber with the intermediate hook recess extending a distance through the intermediate timber and intersecting the second intermediate pin opening; and wherein the improvement further comprises:

a second intermediate hook connected to the second intermediate tie, the second intermediate hook extending through the intermediate hook recess in the intermediate timber; and a second intermediate pin, the second intermediate pin extending through the second intermediate pin opening and through a portion of the second intermediate hook for connecting the second end of the intermediate timber to the second intermediate tie for substantially preventing movement of the second end of the intermediate tie in an upwardly direction away from the second intermediate tie, the second intermediate hook disposed in the intermediate hook recess cooperating to position the second end of the intermediate timber on the second intermediate tie and substantially prevent lateral or longitudinal movement of the second end of the intermediate timber in directions parallel or perpendicular to the ties.

13. The improvement of claim 12 wherein the second intermediate tie comprises a pair of spaced apart second intermediate hook post openings, and wherein the second intermediate hook further comprises:

a second intermediate U-shaped member having opposite ends; and a pair of second intermediate posts, each second intermediate post having opposite ends with one end of one of the second intermediate posts being connected to one end of the second intermediate U-shaped member and one end of the other second intermediate post being connected to the opposite end of the second intermediate U-shaped member, each second intermediate post being insertable through one of the second intermediate hook post openings for connecting the second intermediate hook to the intermediate tie via the pair of second intermediate hook post openings.

14. The improvement of claim 13 wherein each second intermediate post extends at an angle from the second intermediate U-shaped member, and wherein a portion of the second intermediate U-shaped member forms a second intermediate hook opening and wherein a portion of the second intermediate U-shaped member extends a distance upwardly from the upper surface of the second intermediate tie for insertion in the intermediate hook recess, the second intermediate pin extending through the second intermediate pin opening and through the second intermediate hook opening.

15. The improvement of claim 12 wherein one of the ties further is designated as a second end tie and wherein a portion of the second intermediate pin extends a distance beyond the second end of the intermediate timber, and wherein the improvement further comprises:

a second end timber having a first end, a second end, an upper surface and a lower surface, a first pin opening being formed through the first end of the second end timber with the first pin opening extending a distance through the second end timber, the second end timber being disposed on the second intermediate tie with the first end of the second end timber being disposed generally adjacent the second end of the intermediate timber and with a portion of the second intermediate pin being disposed through the first pin opening for connecting the second end timber to the second intermediate tie.

16. The improvement of claim 15 further comprising:

a second end hook connected to the second end tie; and wherein the second end timber includes a second pin opening formed through the second end of the second end timber with the second pin opening extending a distance through the second end timber and a second hook recess being formed through the second end timber near the second end of the second end timber with the second hook recess extending a distance through the second end timber and intersecting the second end pin opening, the second end of the second end timber being disposed on the upper surface of the second end tie with the second hook being disposed in the second hook recess;

a second end pin disposed in the second pin opening with the second end pin being insertable through a portion of the second end hook for connecting the second end of the second end timber to the second end tie for substantially preventing the second end of the second end timber from being moved in an upwardly direction away from the second end tie, the second end pin and the second hook cooperating to removably connect the second end of the second end timber to the second end tie, and the second end hook cooperating to position the second end timber on the second end tie and substantially prevent lateral or longitudinal movement of the second end timber in a direction parallel or perpendicular to the ties.

17. The improvement of claim 16 wherein the second end tie comprises a plurality of spaced apart second hook post openings, and wherein the second end hook comprises:

a second U-shaped member having opposite ends; and a pair of second posts, each second post having opposite ends with one end of one of the second posts being connected to one end of the second U-shaped member and one end of the other second post being connected to the opposite end of the second U-shaped member, each second post being insertable through one of the second hook post openings for connecting the second end hook to the second end tie via the pair of second hook post openings.

18. The improvement of claim 16 wherein each second post extends at an angle from the second U-shaped member, and wherein a portion of the second U-shaped member forms a second hook opening and wherein a portion of the second U-shaped member extends a distance upwardly from the upper surface of the second end tie for insertion in the second hook recess, the second end pin extending through the second pin opening and through the second hook opening.

19. The improvement of claim 15 further comprising:

means for removably securing the second end pin in the second pin opening for substantially preventing the inadvertent removal of the second end pin from the second pin opening.

20. The improvement of claim 19 wherein the second end pin includes a recess extending through one end thereof and extending a distance toward the opposite end, and wherein the means for removably securing the second end pin in the second pin opening further comprises:

second end lag screw means, the second end lag screw means having a head, the second end lag screw means being disposed in the second end of the second end timber to a position wherein a portion of the head on the second end lag screw means engages the second end pin for substantially preventing inadvertent removal of the second end pin from the second pin opening.

21. The improvement of claim 16 wherein the second hook recess is further defined as being formed in the lower surface of the second end timber near the second end of the second end timber, and wherein a portion of the second end hook extends a distance above the upper surface of the second end tie.

* * * * *

Disclaimer and Dedication 5,096,117—S. Hudson Owen, Marshfield, Wis. RAILROAD GRADE CROSSINGS. Patent dated Mar. 17, 1992. Disclaimer and dedication filed Apr. 30, 2003, by the assignee, Kerr-McGee Chemical LLC.

Hereby disclaims and dedicates to the Public, the remaining term of said patent.

*(Official Gazette, July 15, 2003)*